US005312031A

United States Patent [19]

Thelen et al.

[11] Patent Number: 5,312,031

[45] Date of Patent: May 17, 1994

[54] SHEET FEEDER

[75] Inventors: Brian L. Thelen, Fond du Lac; Dennis L. Ramaker, Valders, both of Wis.

[73] Assignee: Nigrelli Systems Inc., Kiel, Wis.

[21] Appl. No.: 938,492

[22] Filed: Aug. 31, 1992

Related U.S. Application Data

[63] Continuation of Ser. No. 726,924, Jul. 8, 1991, abandoned.

[51] Int. Cl.[5] ..... B26F 3/00; B65H 35/10

[52] U.S. Cl. ..... 225/4; 225/100; 53/389.3; 53/389.5

[58] Field of Search ..... 225/1, 2, 4, 96.5, 100, 225/106; 53/389.3, 389.5

[56] References Cited

U.S. PATENT DOCUMENTS

| | | | |
|---|---|---|---|
| 2,776,007 | 1/1957 | Dietz et al. | 225/100 |
| 2,803,304 | 8/1957 | Kessler | 225/4 |
| 2,970,784 | 2/1961 | Kessler | 225/4 X |
| 3,057,527 | 10/1962 | Hannon | 225/106 X |
| 3,888,399 | 6/1975 | Hanson et al. | 225/106 |
| 3,983,774 | 10/1976 | Seragnoli | 53/389.3 X |
| 4,524,658 | 6/1985 | Focke et al. | 53/389.3 X |
| 4,529,114 | 7/1985 | Casper et al. | 225/100 |
| 4,697,726 | 10/1987 | Gaucher | 225/100 |
| 4,811,544 | 3/1989 | Cinotti | 53/389.5 X |
| 4,825,622 | 5/1989 | Nigg | 225/100 X |

*Primary Examiner*—Eugenia Jones
*Attorney, Agent, or Firm*—Francis J. Bouda

[57] ABSTRACT

A continuous web of material having holes and lines of perforations therein is unwound from a roll and fed onto a staging roller. From there it is pushed onto a carrier belt having pins thereon. The pins match with the holes in the web material, and the web is drawn past a fracturing station which separates sections of the web into sheets along the lines of perforations. The individual sheets then are carried by the belt around an accelerator roll which speeds up the sheets to match the speed of receiving objects with which the individual sheets are to be combined. A second staging roller is installed at the in-feed end of the apparatus and coordinated with the first staging roller, so as to provide continuous and uninterrupted feeding of the web and hence individual sheets to the receiving objects.

6 Claims, 2 Drawing Sheets

SHEET FEEDER

This application is a continuation of U.S. patent application Ser. No. 07/726,924 filed Jul. 8, 1991 now abandoned.

BACKGROUND OF THE INVENTION

In a variety of packaging equipment, it is important to be able to feed individual sheets or portions thereof continuously and uninterruptedly into an assembly machine, and one illustration of this is to provide a continuous stream of plastic sheets into a beverage container packing operation, so as to provide a carrier or cover mechanism for a plurality of the container. Such a package is illustrated in the Bonkowski U.S. Pat. Nos. 4,688,367 and 4,281,502.

The preferred plastic sheet of the present invention is a web approximately 10 mil thick of recycled polyethylene terephthlate approximately 8–12" wide. A suitable material is DuPont's polyethylene film PTX-266 (DuPont Trademark SEALER PT).

In order for this material to be continuously and effectively provided at high speed into the container packaging machinery, individual sheets must be fed at spaced intervals, and it has been found inconvenient and impractical to do this from a stack of pre-cut sheets because the characteristics of the material cause such sheets to "block" in the stack and make it relatively impossible to feed them accurately into the machine.

Thus it is an object of the present invention to provide a web of the material in roll form, which can be more readily perforated to provide continuous interconnected sheets readily unwound from the larger roll.

The apparatus of the present invention includes two supports, or unwind stands each one holding a roll of the web material. One of the webs is fed into a staging roller, which carries a plurality of radially outwardly extending pins which engage in the holes punched in the web of material. Surrounding the staging roller is a capture device, which keeps the sheet in close contact with the roller.

A second stand with a second roll of web material is fed onto a second staging roller, also supplied with a capturing device, and on this second staging roller the second web of material waits in readiness for it to be inserted, on command, into the feeding mechanism, when the web from the first roll has been depleted.

Because the material involved in the present invention is sufficiently stiff so that it can be pushed (rather than being pulled), the first staging roller pushes the first web of material into contact with a moving belt which, itself, has a plurality of pins extending outwardly therefrom. The spacing and the timing of the staging roller and the continuous belt are such that the web is carried directly from the staging roller onto the continuous belt by the pins which are moving at the same linear speed.

A preferred speed for the packaging of six or twelve packs of beverages is from 50 to 200 ft./minute.

Adjacent the continuous belt is a fracturing station, which carries a perforation breaker. The action of the perforation breaker and the movement of the continuous belt is such that the perforation breaker presses against the web when a line of perforations is directly opposite the perforation breaker. This separates the preceding web material from the following web material.

In a preferred embodiment, the line of perforations are separated on the web by 10.5", which is appropriate for the length of a sheet of plastic to cover the commercially accepted 12-pack of beverage containers.

After the web has been separated at the line of perforations by the perforation breaker, one of the sheets is carried by the belt around an accelerator roll, which speeds up the movement of the plastic sheet to bring it into linear speed-conformity with the assembly of containers against which the sheet is to be placed.

The assembly of containers is moving along at a 12" pitch, and thus the sheet is speeded up as it turns past the accelerator roll from 10.5" pitch to 12" pitch, and thus the sheet and assembly of containers can be carried in to the packaging machine as desired.

When the first roll of web material is depleted, a detector such as a dancing roller which may be a type of limit-switch assembly detects the end of the web, and signals the "tail breaker" to make one revolution to separate the remaining "tail" of the web.

The second staging roller receives the same signal as the first staging roller, and they rotate in unison so that the leading edge of the second web on the second staging roller is pushed into contact with the continuous belt, so that the leading edge of the second web is immediately behind and in contact with the trailing edge of the first web, and thus there is no discontinuity in the feeding of sheets into the package assembly area.

Thus it is a principal object of the present invention to provide a feeder for individual sheets of plastic material into a packaging machine without any discontinuity in the feeding operation.

A further object of the invention is to provide a sheet separator and accelerator which receives a perforated and punched web of material and separates from it individual sheets.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
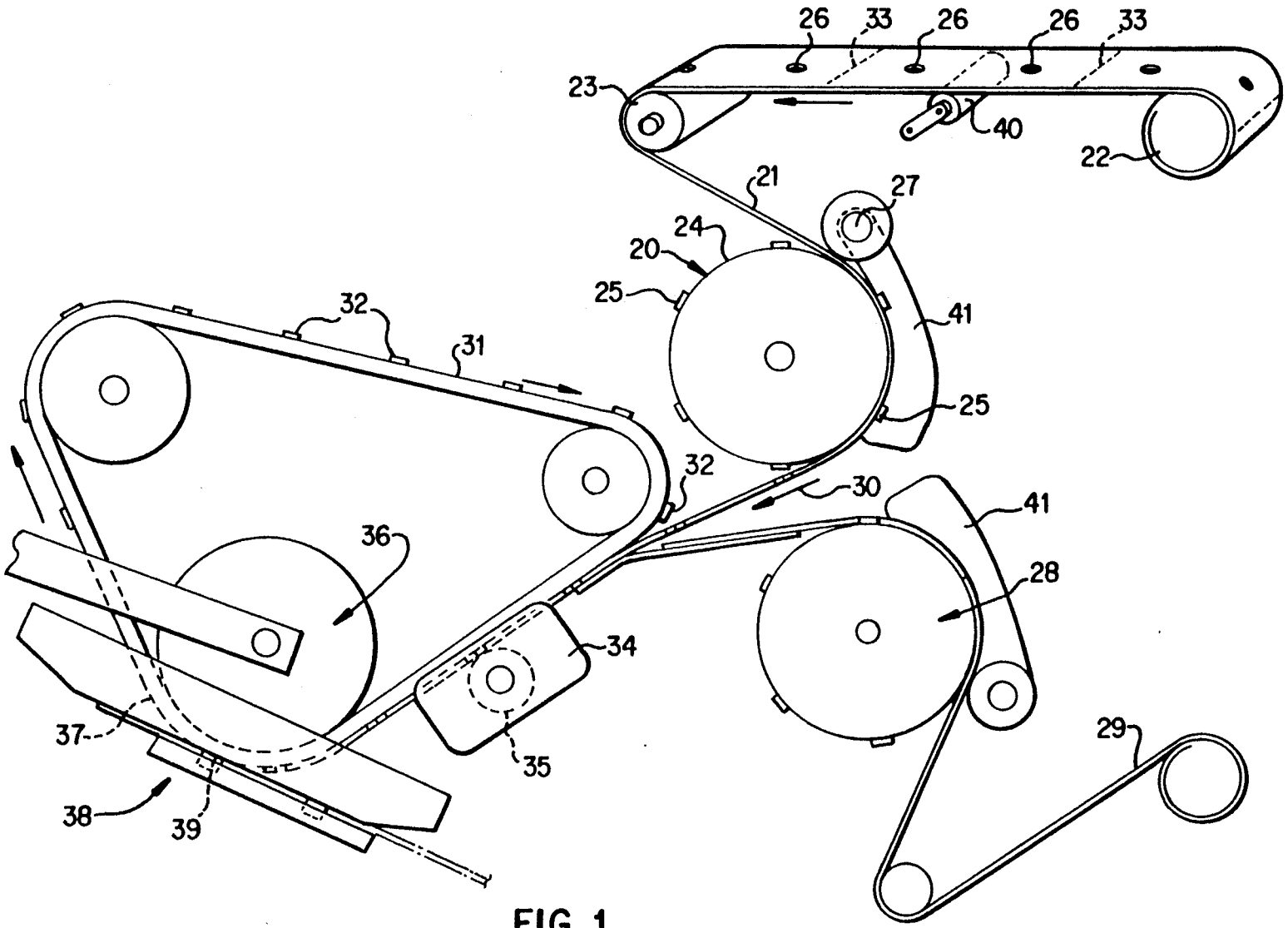
FIG. 1 is an overall schematic assembly of the sheet feeder of the present invention.
Figure 2:
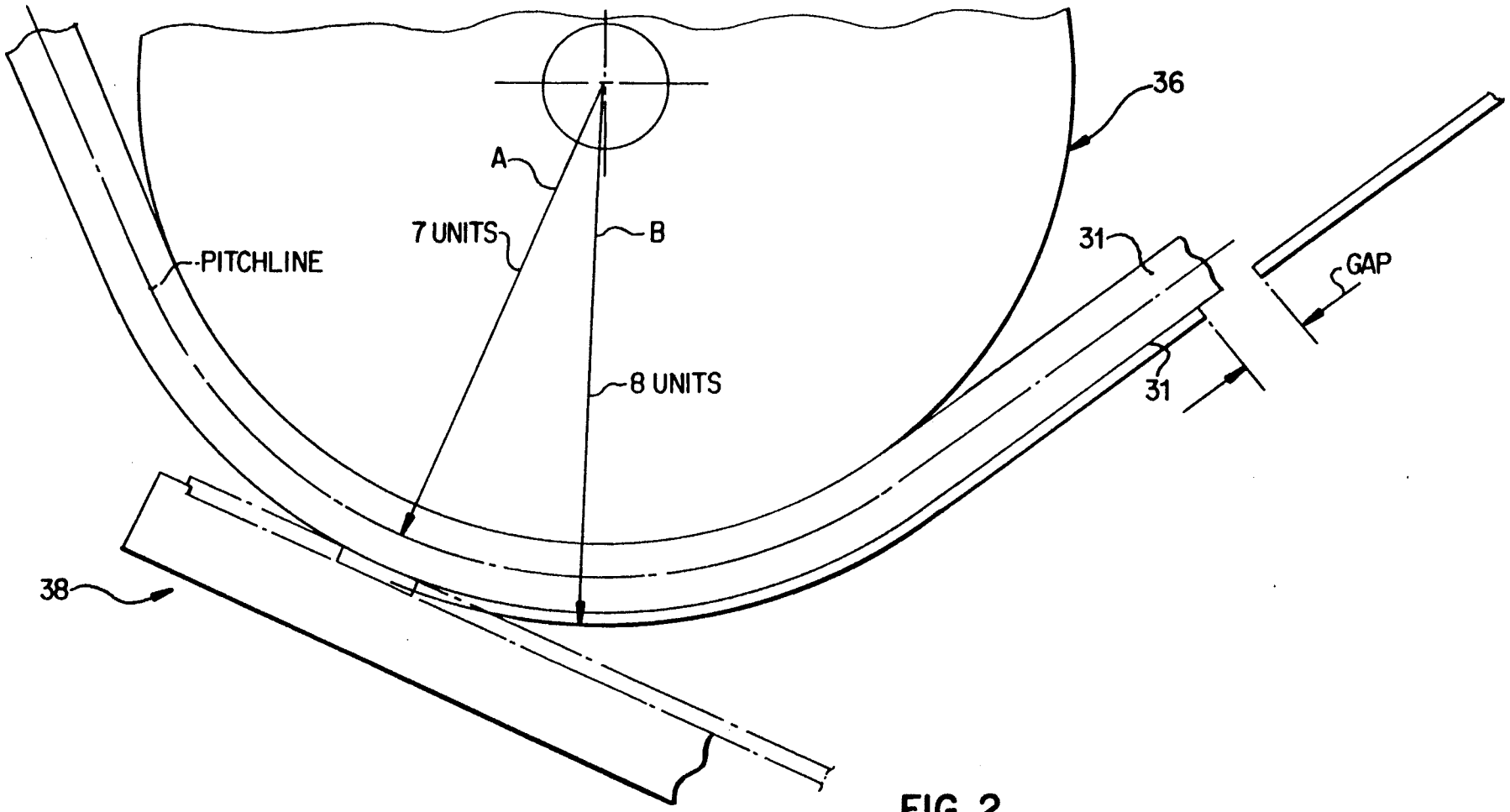
FIG. 2 is an enlarged schematic view of a portion of the continuous belt as it passes from the fracturing roll to the accelerating roll.

Referring now to FIG. 1, a first staging roller receives a web of material 21, which is unwound from a roll 22 of the web material, passing around a turning roller 23, which insures that the web 21 will be in close contact with the surface 24 of the roll 20 and engaged onto pins 25 on both sides of the perforation when the tail break occurs.

A plurality of pins 25 extend outwardly from the surface of the roll 20 to engage the holes 26 in the web 21.

A capture device 41 pivoted at 27 contains the web 21 against the surface 24, insuring that the holes 26 in the web 21 will always be in alignment with the pins 25.

Once the machine operator has placed the web on the pins 25, the machine will automatically feed the web onto the belt 31 when the web of material in the companion staging device has been depleted.

In FIG. 1, a second staging roller 28 feeds a second web 29, and the operation and the construction of the second staging roller are as has been described for the first staging roller.

Assuming that the operating web of material is being provided by the first staging roller 20, and the second staging roller 28 is being held in readiness, one can see that the web 21 is pushed forwardly from the staging roller 20 along the path of the arrow 30, where it comes into contact with the continuous belt 31 (which may preferably be a chain-belt or a timing-belt).

This belt 31 has a plurality of pins 32 extending outwardly therefrom, and holes 26 in the web 21 then match and are brought into alignment with the pins 32.

Because the linear speed of the centerline of the belt 31 is the same as the tangential speed of the staging roller 20, the web moves continuously and uninterruptedly from the supply roll 22 around the staging roller 20 onto the belt 31.

When a line of perforations 33 is in alignment with the perforation breaker 34, an eccentric portion 35 on the breaker 34 presses against the web 21 and snaps the web along the line of perforations. If desired, for larger packages, the breaker can be arranged to skip every other line of perforations and thus separate the web along every other pre-scored line.

As the web 21 continues to be fed by the conveyor 31 forwardly beyond the breaker 34, the belt starts to turn around a combining device which includes an accelerator roller 36.

Because the pins 32 are on the outer surface 37 of the belt 31, the tangential speed of the sheet connected thereto accelerates in a ratio equal to the difference between the distance (A) from the center of the accelerator roll 36 to the pitchline of the belt, and the distance (B) from the centerline of accelerator roller 36 to the point where the belt is tangent to the sheet-accepting mechanism 38 (i.e., to a point beyond the pitchline).

As an example, when the sheets have a "pitch" or spacing of 10.5", and the preferred pitch on the packaging machine 38 is 12", the machine is arranged so that the radius from the center of the accelerating roll to the pitchline of the belt is seven units, and the distance from the centerline of accelerator roll to the contact point 39 is 8 units.

Thus the sheet is not only accelerated to match the speed of the packaging equipment, but also the sheet must be separated from following sheets in the web 21.

This arrangement continues until all of the sheets have been consumed from the initial supply roll 22.

When the dancer roll or detector 40 detects that the end of the web 21 has left the roll 22, it immediately signals the cutoff perforation breaker 27) to break off the "tail" of the web 21, so that a pre- determined amount of the web 21 will be finished and furnished to the assembly unit and onto the continuous conveyor 31.

The same detection mechanism that detected the end of the web 21 (and controls the movement of the staging roller 20) also starts into rotation the second staging roller 28. On the second staging roller 28, the leading edge of the web 29 has been pre-positioned so that as the last portion of the web 21 passes from the staging roller 20 and onto the continuous conveyor 31, the leading edge of web 29 will be directly behind and in contact therewith to be picked up by succeeding pins 32 on the conveyor 31, and thus the operation continues uninterruptedly.

Thus it can be seen that the present invention includes two principal features:

1. The plurality of staging rolls which feed the webs in time sequence onto the continuous conveyor so that there is no interruption of web material being fed into the assembly device.

2. The utilization of the turning radius of the accelerator roll and the thickness of the continuous conveyor 31 to accelerate the speed of the advancing sheet from a 10.5 pitch to a 12 pitch without changing the linear speed of the belt or the tangential speed of the staging rollers.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described our invention, what we claim as new and desire to protect by Letters Patent are the following:

1. A sheet feeder for a web of pre-punched and prescored web material including at least one web staging device, transport means, a fracturing station, and a combining device, said staging device constructed and arranged to receive the web having pre-punched holes and prescored lines in the web material.

means to feed said web to said staging device, said transport means adapted to carry said web from said staging device to said fracturing station, said fracturing station including means to separate said web along said pre-scored lines into discrete sheets, said transport means also adapted to carry said sheets from said fracturing station to said combining device, said transport means being a belt having a pitchline and including pins to engage the pre-punched holes in said web and carry the web to said fracturing station, said combining device including an accelerator for increasing the linear speed of said sheet on said transport means after the fracturing station has separated the sheet from the web, and wherein the accelerator of said combining device includes a roller which carries said transport means around a radius in a manner wherein the pins on said transport means move with a linear speed faster than the pitchline of said transport means, thus moving the sheet held by the pins faster than the linear speed of the web entering the fracturing station and causing a separation between the web and the sheet leaving the fracturing station.

2. The sheet feeder of claim 1 wherein the radius from the center of the roller to the pitchline of the transport means is seven units and the distance from the center of the accelerator roller to the sheets supported on the surface of the transport means is eight units.

3. A sheet feeder for a web of pre-punched and pre-scored web material including at least one web staging device, transport means, a fracturing station, and a combining device, said staging device constructed and arranged to receive the web having pre-punched holes and pre-scored lines in the web material.

means to feed said web to said staging device, said transport means adapted to carry said web from said staging device to said fracturing station, said fracturing station including means to separate said web along said pre-scored lines into discrete sheets, said transport means also adapted to carry said sheets from said fracturing station to said combining device, said transport means being a belt having a pitchline and including pins to engage the pre-punched holes in said web and carry the web to said fracturing station, said combining device including an accelerator for increasing the linear speed of said sheet on said transport means after the fracture station has separated the sheet from the web, and wherein the accelerator of said combining device includes a roller which carries said transport means around a radius in a manner wherein the pins on said transport means move with a linear speed faster than the pitchline of said transport means, thus moving the sheet held by the pins faster than the linear speed of the web entering the fracturing station and causing a separation between the web and the sheet leaving the fracturing station, and including a sheet-accepting device which moves at a linear speed the same as the speed of the pins on the transport means.

4. The sheet feeder of claim 3 including transferer means to move the sheet from the transport means to the sheet-accepting device.

5. In a process for applying sheets to be separated from pre-punched web material to packaging equipment, supplying a web of material having pre-punched holes and pre-scored lines to a staging roller having pins which enter the pre-punched holes, moving said web from said staging roller to a transport device, said transport device having a pitchline and having pins which also engage the pre-punched holes in said web, moving said web on said transport device to a fracturing station which separates said web into sheets along said pre-scored lines, moving said sheets on said transport device from said fracturing station to an accelerating station, increasing the linear speed of said sheets as said sheets and said transport device move through said accelerating station, and applying said sheets to a sheet-accepting device.

6. The process of claim 5 wherein said accelerating station includes an accelerator roller and said sheets, as they move through the accelerating station, move along an arc of a circle the radius of which is greater than the distance between the center of the accelerator roller and the pitchline of the transport devices of which the sheets are supported.

* * * * *